US008342813B2

(12) United States Patent
Ferris et al.

(10) Patent No.: US 8,342,813 B2
(45) Date of Patent: Jan. 1, 2013

(54) COMBINED PUMPING SYSTEM COMPRISING A GETTER PUMP AND AN ION PUMP

(75) Inventors: Michael Laurence Ferris, Colorado Springs, CO (US); Andrea Conte, Milan (IT)

(73) Assignee: Saes Getters S.p.A., Lainate (MI) (IT)

( * ) Notice: Subject to any disclaimer, the term of this patent is extended or adjusted under 35 U.S.C. 154(b) by 239 days.

(21) Appl. No.: 12/920,797

(22) PCT Filed: Mar. 26, 2009

(86) PCT No.: PCT/EP2009/053634

§ 371 (c)(1),
(2), (4) Date: Sep. 2, 2010

(87) PCT Pub. No.: WO2009/118398

PCT Pub. Date: Oct. 1, 2009

(65) Prior Publication Data

US 2011/0014063 A1 Jan. 20, 2011

(30) Foreign Application Priority Data

Mar. 28, 2008 (IT) ..... MI20080112 U
Aug. 1, 2008 (IT) ..... M120080250 U

(51) Int. Cl.
*F04B 37/02* (2006.01)
*F04F 99/00* (2009.01)

(52) U.S. Cl. ..... 417/49

(58) Field of Classification Search ..... 417/48, 417/49, 51

See application file for complete search history.

(56) References Cited

U.S. PATENT DOCUMENTS

| | | | | |
|---|---|---|---|---|
| 3,236,442 | A * | 2/1966 | Davis et al. | 417/49 |
| 3,596,123 | A * | 7/1971 | Levin | 313/7 |
| 5,221,190 | A | 6/1993 | Romer et al. | 417/51 |
| 5,324,172 | A | 6/1994 | Manini et al. | |
| 6,149,392 | A * | 11/2000 | Conte | 417/51 |
| 7,301,269 | B2 * | 11/2007 | Gofuku et al. | 313/495 |
| 2006/0231773 | A1 | 10/2006 | Katagiri et al. | |

FOREIGN PATENT DOCUMENTS

| | | | |
|---|---|---|---|
| EP | 719609 | | 9/2000 |
| GB | 2164788 | * | 3/1986 |
| GB | 2164788 | A | 3/1986 |
| JP | 58-117371 | | 7/1983 |
| JP | 06-140193 | | 5/1994 |
| JP | 07-263198 | | 10/1995 |

OTHER PUBLICATIONS

PCT International Search Report for PCT/EP2009/053634 filed on Mar. 26, 2009 in the name of SAES Getters S.P.A.
PCT Written Opinion for PCT/EP2009/053634 filed on Mar. 26, 2009 in the name of SAES Getters S.P.A.

(Continued)

*Primary Examiner* — Devon Kramer
*Assistant Examiner* — Bryan Lettman
(74) *Attorney, Agent, or Firm* — Steinfl & Bruno LLP

(57) ABSTRACT

A combined pumping system comprises a getter pump and an ion pump. The getter and ion pumps are mounted on a same flange and are arranged on the same side of the flange at two different points thereof. The flange can be mounted to a vacuum chamber, such that the combined pumping system evacuates the vacuum chamber.

9 Claims, 3 Drawing Sheets

OTHER PUBLICATIONS

PCT International Preliminary Report on Patentability for PCT/EP2009/053634 filed on Mar. 26, 2009 in the name of SAES Getters S.P.A.

O'Hanlon, J.F. "A User's Guide to Vacuum Technology." 3rd edition, chapters 14, 20, pp. 247-262, pp. 379-402 (2003).

* cited by examiner

COMBINED PUMPING SYSTEM COMPRISING A GETTER PUMP AND AN ION PUMP

CROSS REFERENCE TO RELATED APPLICATIONS

The present application is the US national stage of International Application PCT/EP2009/053634 filed on Mar. 26, 2009 which, in turn, claims priority to Italian Application MI2008U000112, filed on Mar. 28, 2008 and Italian Application MI2008U000250 filed on Aug. 1, 2008.

The present invention relates to a combined pumping system comprising a getter pump and an ion pump.

There are many industrial and scientific instruments and systems that require ultra-high vacuum conditions (indicated in the field as UHV, corresponding to pressures lower than $10^{-5}$-$10^{-6}$ Pa) for their operation. Among these instruments and systems, particle accelerators and electron microscopes may be mentioned. In order to generate these vacuum levels, pumping systems comprising a pump that is defined main pump, e.g. a rotary or a membrane pump, and a UHV pump, e.g. a turbo-molecular, getter, ion or cryogenic pump, are generally used. The main pump can start operating at atmospheric pressure and can bring the pressure inside the vacuum chamber of an instrument down to values of about $10^{-1}$-$10^{-2}$ Pa. At these pressures it is possible to activate the UHV pump, which brings the pressure of the system down to values of about $10^{-8}$-$10^{-9}$ Pa.

At present, the most diffused UHV pumps are ion pumps, since they can practically block all gases (although having a poor pumping efficiency with respect to hydrogen) and they can provide an indication, although approximate, of the pressure value inside the evacuated chamber. The latter feature is particularly appreciated by manufacturers and users of vacuum instruments, because it allows to have a control of the system conditions and possibly to interrupt its operation when the pressure inside the chamber increases up to critical values.

Ion pumps are usually made by an assembly of a plurality of equal members. In each of these members, ions and electrons are generated by ionization of the gaseous species present in the chamber as effect of the high electrical fields being applied. A magnet arranged around each member provides the electrons with a non-linear (generally helical) trajectory, so to improve their ability to ionize other molecules present in the chamber. The set of ions so generated is embedded in the member walls, partially due to ion implantation into the same walls and partially due to a "burial" effect underneath titanium layers formed by the deposition of atoms (or clusters of atoms) generated by the erosion of the walls upon ion bombardment. Titanium has also an intrinsic gettering ability, i.e. it can interact with simple gaseous molecules fixing them through the formation of chemical compounds or the physical sorption.

Because an ion pump usually consists in an assembly of a plurality of equal members, its gas sorbing characteristics (the sorbing speed in particular) are an essentially linear function of its size and weight. Since the above-mentioned systems generally require a plurality of pumping units connected to different zones of the vacuum chamber, the set of ion pumps needed for the operation of these systems increases their overall weight and size in a non-negligible way.

Getter pumps operate on the principle of the chemical sorption of reactive gaseous species such as oxygen, hydrogen, water and carbon oxides by members made of non-evaporable getter materials (known in the field as NEG). The most important NEG materials are zirconium- or titanium-based alloys. Getter pumps are described for example in U.S. Pat. No. 5,324,172 and U.S. Pat. No. 6,149,392. These pumps have a gas sorbing speed that is remarkably higher than the sorbing speed of ion pumps having similar size and can remove hydrogen much more effectively with respect thereto, whereas their pumping efficiency is poor for hydrocarbons and null for rare gases and they can not provide a measure of the pressure inside the chamber.

The combined use of ion and getter pumps provides pumping systems for UHV that are particularly efficient. Similar pumping systems are known for example from the published patent applications JP 58-117371 and GB 2,164,788 as well as from the U.S. Pat. No. 5,221,190, which relate to vacuum systems as such, and from the published patent applications JP-A-06-140193 and JP-A-07-263198, which relate to particle accelerators whose vacuum chamber is kept evacuated by using separated ion and getter pumps.

The pumping systems described in the above-cited documents provide for the use of an ion pump as the main pump, and of a getter pump as the auxiliary pump of smaller size than the main one. These documents do not solve the main problem related to the use of ion pumps, i.e. their big weight, large size and high energy consumption.

Patent application US 2006/0231773 describes an electron microscope wherein the vacuum system comprises an ion pump and a getter pump. This document reverses the traditional situation and suggests the use of a getter pump as the main pump in order to exploit its reduced size and the use of a relatively small ion pump for blocking the gases not sorbed by the getter pump. This system allows to improve the weight and the size of the vacuum system, but yet has two separated pumps that represent a non-negligible encumbrance for the overall system. Moreover, it is known that the critical points in the UHV systems are all the apertures and connections in the chamber wall. This happens because, due to possible defective seals at the microscopic level of flanges, gaskets or brazing materials (in particular in the case of systems that are heated and wherein different thermal dilations of parts made of different materials occur), these apertures may represent preferred degradation points for the vacuum conditions. The system with two separated pumps disclosed in patent application US 2006/0231773 needs at least two different access points from the outside, one for supplying the ion pump (or more than one if the system comprises more than one ion pump) and another for the getter pump. It can not be considered an optimal feature from the point of view of the manufacturing of a system that must operate in ultra-high vacuum. It is therefore object of the present invention to provide a combined getter-ion pump, which overcomes the disadvantages of the prior art.

According to the present invention, said object is achieved with a combined pumping system comprising a getter pump and an ion pump, wherein the getter pump and the ion pump are mounted on a same flange and are arranged on the same side of the flange at two different points thereof.

The invention will be described in detail in the following with reference to the drawings, wherein.

Figure 1:
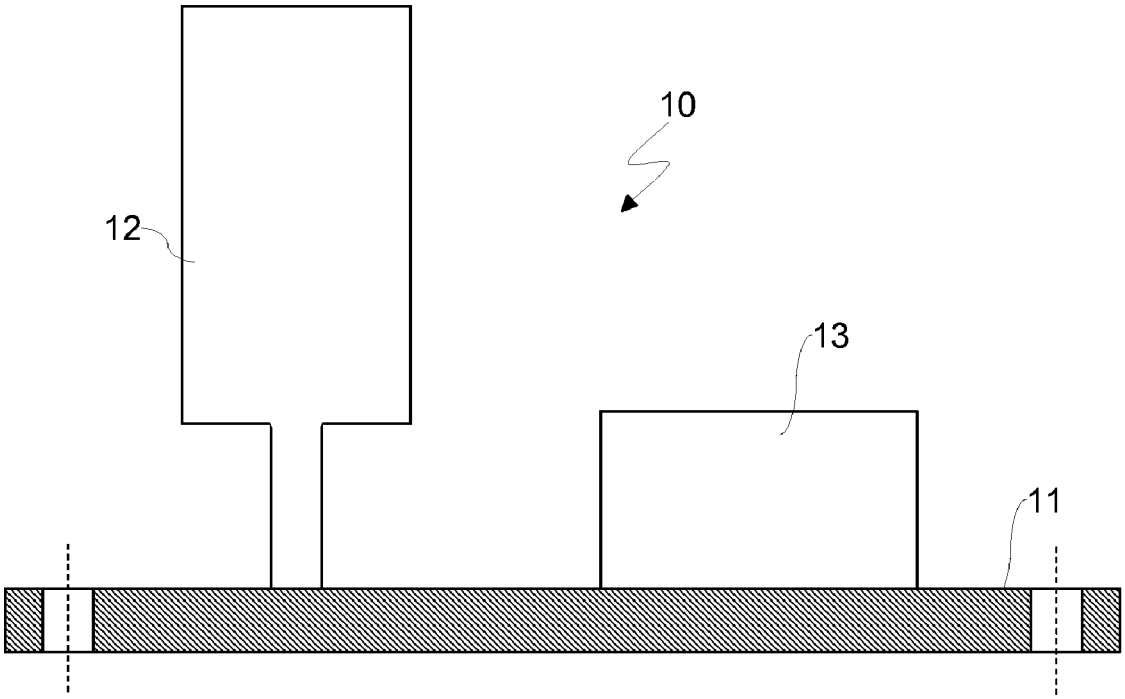
FIG. 1 shows a schematic cross-sectional view of a pumping system of the invention.

FIG. 1 shows a schematic cross-sectional view of a pumping system of the invention. The system, 10, comprises a flange 11 on which a getter pump 12 and an ion pump 13 are mounted. The getter pump 12 and the ion pump 13 are arranged on the same side of flange 11 at two different points thereof.

Figure 2:
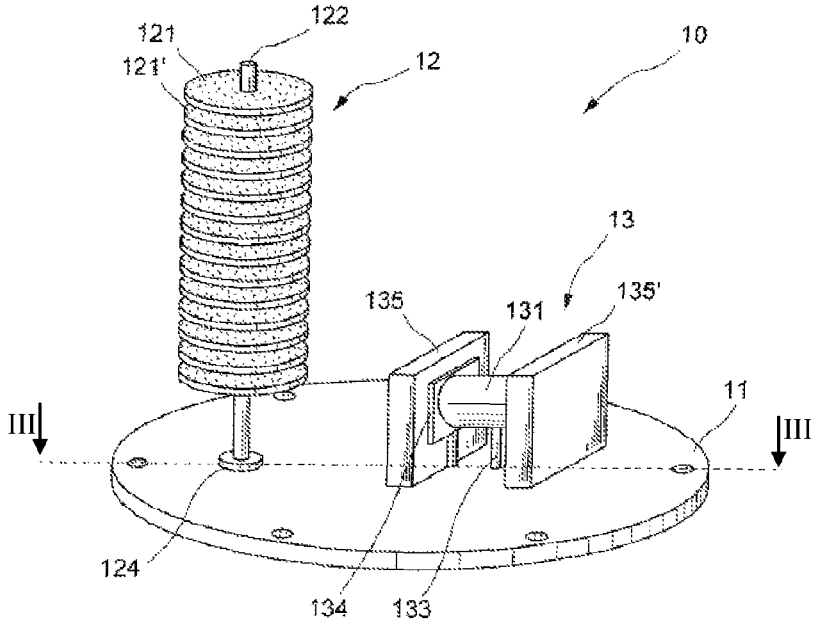
FIG. 2 shows a perspective simplified view of a first embodiment of the pumping system of the invention.
Figure 3:
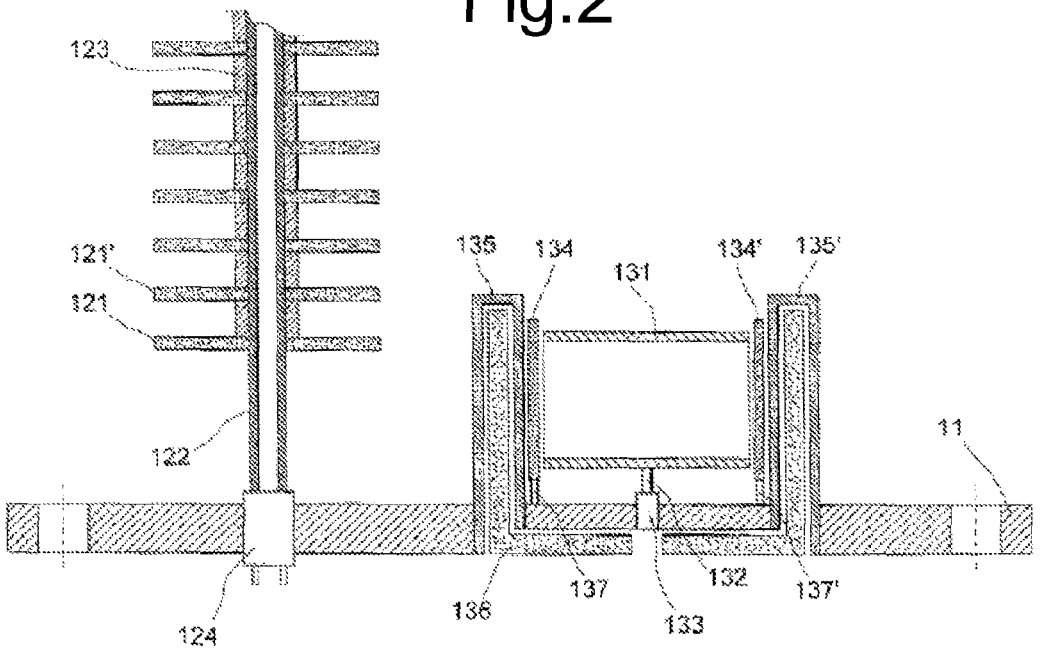
FIG. 3 shows a cross-section along line III-III' of the system of FIG. 2.

FIGS. 2 and 3 show a first embodiment of the pumping system of the invention. It is noted that these drawings show an ion pump in its simplest configuration, i.e. wherein only one cylindrical anode is present, but the anode elements could be more than one.

The getter pump 12 may be formed of elements made of a NEG material having various shapes and assembled according to different geometries. The getter pump 12 is comprised of a series of discs 121, 121', . . . made of NEG material stacked up on a central support 122 and kept spaced from each other e.g. by means of metal rings 123 (not visible in FIG. 1); the central support 122, e.g. made of ceramic (alumina is preferred), is hollow and houses at its inside a heating element (not shown in the drawings), which may be formed e.g. of a metal wire resistor made to pass through the holes of a support that is also made of a ceramic material (the holes are parallel to the axis of the support and are through-holes with respect thereto). Typically, support 122 is fixed to a connector 124, which is provided with electrical feedthroughs, is usually made of ceramic and is fixed to flange 11 by brazing. The getter pump shown in the drawings does not have shields around the NEG elements so as to maximize its gas sorbing speed. However, the getter pump may comprise metal shields (for example in the form of perforated plates or grids) arranged around the assembly of the elements made of NEG material, in order to retain metal particles possibly lost by the NEG elements, e.g. when handling the getter pump during its introduction in a vacuum chamber. The discs 121, 121', . . . may be made of sintered powders of NEG materials and therefore may be relatively compact, but they are preferably porous in order to increase the size of the exposed surface area of the material and thereby the gas sorbing properties of pump. Porous elements made of NEG material may be manufactured, for example, according to the process described in patent EP 719609 B1 in the applicant's name. Alternative embodiments for NEG getter pumps or NEG materials useful for the invention are described in various publications such as, for example, patents EP 719609 and U.S. Pat. No. 5,324,172 both in the applicant's name.

The ion pump 13 is formed of a single member of the type of those being repeated in the traditional ion pumps. This pump comprises a single anode element 131 in the form of a hollow cylindrical body provided with open ends and made of a conductive material, generally a metal; the cylindrical body is kept in place by a mount 132 fixed to flange 11 by means of a connector 133 similar to connector 124 and in turn provided with one or more electrical feedthroughs insulated from the flange. The axis of the anode element 131 is parallel to the inner surface of the flange. Two electrodes 134, 134' made of titanium, tantalum or molybdenum face the open ends of the anode element 131 and are arranged at a small distance therefrom (about 1 mm). The assembly formed of the anode element 131 and of the electrodes 134 and 134' is arranged between two prismatic-shaped hollow elements 135 and 135'. The cavity of these elements is outwardly open, i.e. from the side of flange 11 opposite to the side where the anode element 131 is arranged, and the assembly of the two cavities defines a seat for a permanent magnet 136. Therefore, when the pumping system is connected to a vacuum chamber, the permanent magnet 136 is arranged on a side of flange 11 external to the chamber.

The magnet 136 may be any known permanent magnet suitable for generating high magnetic fields, e.g. of the neodymium-iron-boron or the samarium-cobalt type. The magnet 136 is simply inserted in the seat and may be easily removed in order to prevent it from being demagnetized in case of heating of the getter pump or of the chamber to which the system of the invention is connected. The walls of the two elements 135, 135', and in particular the walls (generally rectangular-shaped) that are closer to electrodes 134 and 134' and parallel thereto, preferably have a reduced thickness, e.g. in the range of about 0.5-1.5 mm, in order not to shield the magnetic field generated by magnet 136. The mount 132 of the anode element 131 is hollow in order to allow the passage of the power supply to the anode element itself. The magnet 136 is perforated in order to allow the connection of electrical wires to connector 133. One single wire may possibly be provided for supplying the anode element 131; electrical contacts needed for measuring the pressure in the vacuum chamber may also be present. The electrodes 134 and 134' are shown supported by mounts 137 and 137' that have the simple mechanical function of keeping the electrodes in place. This is possible when the two electrodes are kept at the potential of the flange. Alternatively, the two electrodes may be in turn electrically supplied (and kept at the same potential with respect to each other and at a negative potential with respect to the potential of the anode element 131). In this case mounts 137 and 137' may be in turn connected through supplying wires to further feedthroughs provided in connector 133. Alternatively, it is possible to electrically connect the two electrodes to each other through a contact (not shown in the drawings), maintaining them at the same potential and connect said contact to a single feedthrough of connector 133, thus leaving to mounts 137 and 137' a mechanical function only.

The magnet is preferably a permanent-type magnet, e.g. chosen between the well-known magnets of the samarium-cobalt or iron-boron-neodymium type. Given the configuration of the pump of the invention, during the heating step (for activating or reactivating the getter material or for degassing the vacuum chamber to which the pumping system is connected), the magnet may be easily removed from its seat in order to prevent it from being demagnetized.

Figure 4:
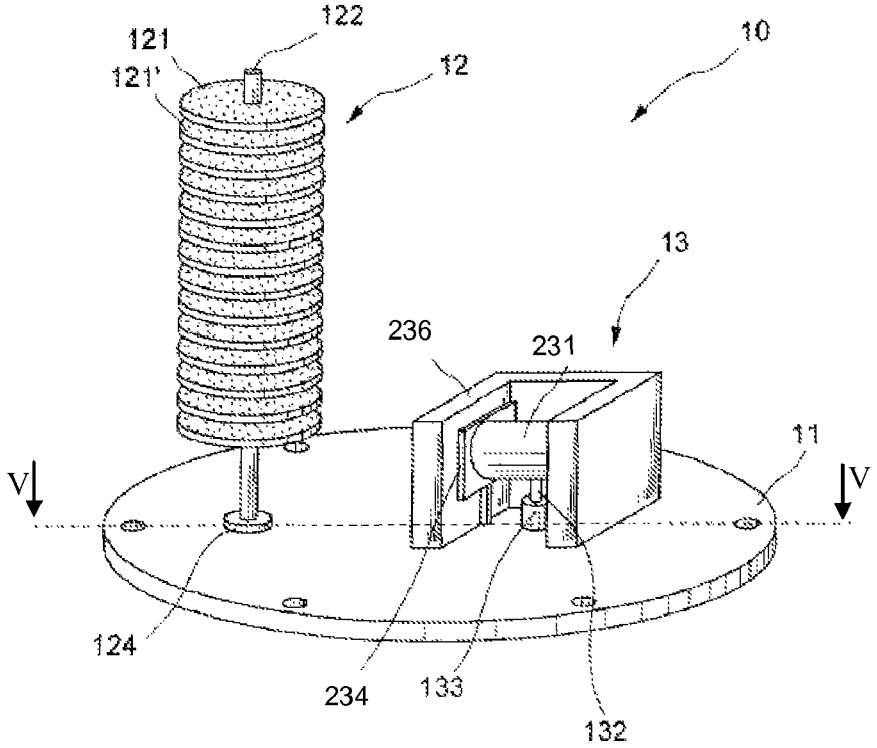
FIG. 4 shows a perspective simplified view of an alternative embodiment of the invention.
Figure 5:
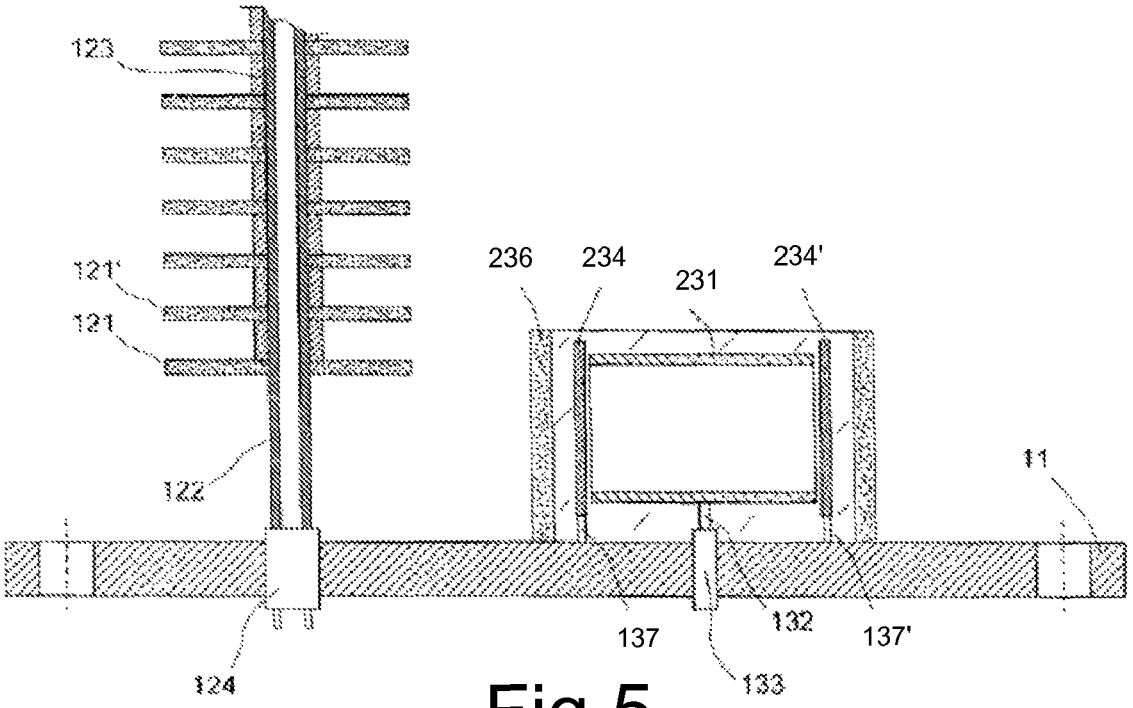
FIG. 5 shows a cross-section along line V-V' of the embodiment of FIG. 4.

FIGS. 4 and 5 show an alternative embodiment of the invention in which the ion pump 13 is provided with a permanent magnet 236 having a Curie point higher than 350° C., i.e. higher than the most common activation temperatures of the getter materials of the getter pump arranged in the vacuum chamber.

As shown in the drawings, magnet 236 is U-shaped and an anodic element 231 and a pair of electrodes 234 and 234' are inserted therein. Due to its high Curie point, magnet 236 can withstand the activation temperatures of the getter materials of the getter pump 12, whereby it can be arranged on a side of flange 11 internal to a vacuum chamber when the pumping system is connected thereto. This configuration is particularly advantageous, because it does not require any seat to arrange the magnet on the flange. The magnet 236 can be fixed to flange 11 in several possible ways, e.g. by screws, springs and the like.

Preferably, a permanent magnet of the so-called "Alnico" type is used. Alnico is an acronym indicating a composition based on aluminum (8-12% by weight), nickel (15-26%), cobalt (5-24%) with the possible addition of small percentages of copper and titanium, the rest of the composition being formed of iron. In addition to generating very high magnetic fields, Alnico magnets have a Curie point among the highest ones of all magnetic materials, around 800° C., whereby they can withstand any thermal treatment a getter pump may undergo.

Given the very small size of the two pumps, and in particular of the ion pump, the system of the invention can occupy on the flange 11 a rectangular area not larger than 100×50 mm, so as to be fixed onto a single circular flange having a diameter smaller than 125 mm (corresponding to a flange type known in the field as CF 100) or onto rectangular flanges having a size smaller than 100×150 mm. The flange is made of materials known in the field, e.g. AISI 316 L or AISI 304 L steel.

The invention claimed is:

1. A combined pumping system comprising a getter pump and an ion pump, wherein said getter and ion pumps are mounted on a same flange, said flange having two planar sides, with said ion and getter pumps arranged on a same side of said sides at two different points thereof.

2. The system according to claim 1, wherein a magnet for operation of the ion pump is arranged in a seat formed in the flange and on a side of the sides external to a vacuum chamber when the pumping system is connected thereto.

3. The system according to claim 2, wherein the magnet is a permanent magnet and has a samarium-cobalt or an iron-boron-neodymium composition.

4. The system according to claim 1, wherein a magnet for operation of the ion pump is arranged on a side of the sides internal to a vacuum chamber when the pumping system is connected thereto.

5. The system according to claim 4, wherein the magnet is a permanent magnet and has a Curie point higher than 350° C.

6. The system according to claim 4, wherein the magnet is a permanent magnet and has a weight percentage composition of aluminum 8-12%, nickel 15-26%, cobalt 5-24% and a remainder including percentages of iron, copper and/or titanium.

7. The system according to claim 1, wherein the getter pump is formed of a series of discs made of a non-evaporable getter material stacked up on a central support.

8. The system according to claim 1, wherein the ion pump is comprised of two electrodes made of titanium, tantalum or molybdenum, planar and parallel to each other, between which at least one anode element made of titanium and shaped as a hollow cylindrical body is arranged, an axis of the anode element being perpendicular to a surface of the electrodes.

9. A combined pumping system comprising a getter pump and an ion pump, wherein said getter and ion pumps are mounted on a same flange and arranged on a same side of said flange at two different points thereof, wherein a magnet for operation of the ion pump is arranged in a seat formed in the flange and on a side of the flange external to a vacuum chamber when the pumping system is connected thereto.

* * * * *